United States Patent [19]

Hocking

[11] Patent Number: 4,947,809

[45] Date of Patent: Aug. 14, 1990

[54] IGNITION BOOT

[75] Inventor: Bryan W. Hocking, East Keilor, Australia

[73] Assignee: GSA Controls Pty. Ltd., Melbourne, Australia

[21] Appl. No.: 241,984

[22] PCT Filed: Oct. 16, 1987

[86] PCT No.: PCT/AU87/00351

§ 371 Date: Jul. 15, 1988

§ 102(e) Date: Jul. 15, 1988

[87] PCT Pub. No.: WO88/02940

PCT Pub. Date: Apr. 21, 1988

[30] Foreign Application Priority Data

Oct. 17, 1986 [AU] Australia ..... 08558

[51] Int. Cl.[5] ..... F01L 15/00

[52] U.S. Cl. ..... 123/169. PA; 439/125

[58] Field of Search ..... 123/169 R, 169 PA, 169 PB, 123/169 PH; 439/125, 126

[56] References Cited

U.S. PATENT DOCUMENTS

| | | | |
|---|---|---|---|
| 2,286,918 | 6/1942 | Mascuch | 123/169 PH |
| 2,553,114 | 5/1951 | Sailler | 439/125 X |
| 2,904,769 | 9/1959 | Sampson et al. | 439/125 |
| 3,128,139 | 4/1964 | Estes | 439/126 |
| 4,637,358 | 1/1987 | Yano et al. | 123/169 PA |
| 4,768,477 | 9/1988 | Richardson | 123/169 PA |

FOREIGN PATENT DOCUMENTS

| | | |
|---|---|---|
| 0146131 | 12/1949 | Australia . |
| 2730240 | 1/1979 | Fed. Rep. of Germany . |
| 3302878 | 8/1984 | Fed. Rep. of Germany . |
| 1234916 | 5/1960 | France . |
| 0792726 | 4/1958 | United Kingdom . |
| 1008229 | 10/1965 | United Kingdom . |
| 1445681 | 8/1976 | United Kingdom . |

*Primary Examiner*—Willis R. Wolfe

*Attorney, Agent, or Firm*—Roylance, Abrams, Berdo & Goodman

[57] ABSTRACT

An elongated ignition boot for a spark plug having an insulator section and a terminal, the spark plug being located in a spark plug receiving cavity of a cylinder. The ignition boot has a spark plug receiving aperture, a lead receiving aperture to receive an ignition lead and connector terminal, a channelway passing from the spark plug receiving aperture to the ignition lead receiving aperture, and a sealing portion located peripherally at or adjacent the spark plug receiving aperture and urgable against the wall of the spark plug receiving cavity. The channelway includes a first chamber adjacent the spark plug receiving aperture having a transverse dimension of the terminal and that part of the insulator section located therein, a second chamber, a terminal location chamber located between the first chamber and the second chamber, a pair of circumferential restrictions in the terminal location chamber adjacent the first chamber and second chamber of transverse dimension less than the transverse dimension of the terminal connector, and a sealing chamber intermediate the spark plug receiving aperture and the first chamber, to engage the insulator section of the spark plug.

11 Claims, 1 Drawing Sheet

IGNITION BOOT

FIELD OF THE INVENTION

The present invention relates to an ignition boot for a spark plug which is usable in an internal combustion engine.

BACKGROUND OF THE INVENTION

It is well known in internal combustion engines that ignition leads are connected to spark plugs which transmit the required energy for sparking of the plugs. In this respect interruption to this energy supply either through incorrect or insufficient connection between the ignition lead and spark plug or interruption by presence of excess moisture is to be avoided. If such does occur the fuel injected into the combustion chamber is not ignited which leads to fouling of the plug and missing of the engine.

With the recent introduction of lead-free fuel onto the Australian market, an additional ramification of the engine missing has arisen due to fuel in the raw state being fed into the catalytic converter in the exhaust system. Recently it has been revealed that the effectiveness of catalytic converters can be reduced dramatically below that prescribed under Australian Emission Regulations by running an engine whilst it is missing for a short time for example 4 minutes. The catalytic converters thus overheated from exothermic reaction with raw fuel cannot be economically reconditioned and thus replacement of the converter is recommended.

Accordingly whilst there have been numerous arrangements to ensure proper connection between an ignition lead and spark plug and also to incorporate covers over the connection to reduce shorting, the introduction of lead-free petrol and catalytic converters has intensified the need to provide improved connections and seals.

With the above needs in mind, an ignition boot is provided which has four separate features. Each of the features is independent of any other of the four and thus it will be readily apparent to those skilled in the art that each of the features could be included into an ignition boot in the absence of the others. The present invention is therefore not specifically restricted to any combination of those aspects though of course the entire combination of the four is the most preferred.

DESCRIPTION OF THE INVENTION

The first aspect of the present invention comprises an ignition boot for a spark plug located in a spark plug receiving cavity of a cylinder comprising a spark plug receiving aperture at one end and sealing means located peripherally at or adjacent the spark plug receiving aperture and urgable against wall(s) of the spark plug receiving cavity thereby substantially preventing ingress of dust or moisture to the spark plug.

Typically the sealing means is a resilient material and by insertion of the boot over the end of the spark plug, forces the sealing ring against said walls.

In one preferred embodiment the sealing means is a ring located about the spark plug receiving aperture of the boot and sealing against the base wall of the spark plug receiving cavity in the cylinder head. With modification the sealing ring may simultaneously seal against the side wall of the cavity.

In a further preferred embodiment the sealing ring is provided adjacent the end of the spark plug receiving aperture of the boot such that it bears solely on the side wall of the cavity in the cylinder head. In this configuration the ring is biased in a direction radially and rearwardly from the receiving spark plug aperture and forms a taper to assist sealing with the cavity wall upon inserting the boot over the spark plug. Alternatively, the ring may extend radially and outwardly of the spark plug receiving aperture.

In a second aspect of the invention an ignition boot is provided for a spark plug having an insulator section and a terminal, the boot comprising a spark plug receiving aperture connecting to a sealing chamber to engage the insulator section, and a first chamber having a transverse dimension substantially exceeding the transverse dimension of the terminal and that part of the insulator section located therein.

As such the first chamber is specifically designed to accommodate both common sizes of plug insulator viz 10.5 mm and 12.2 mm diameter at gauge length as per ISO Standards 2344 and 1919 respectively. The space or undercut between the plug insulator portion and the chamber walls is designed to achieve a minimum change in spark plug to boot entry force for alternative plug insulator sizes nominated.

The first chamber and sealing chambers co-operate to preferably effectively seal the plug insulator section and thus the chamber from the cavity in the cylinder head but also give appropriate sensitivity to allow easy plug terminal engagement and disengagement.

In a third aspect of the present invention there is provided an ignition boot having a spark plug receiving end, an ignition lead receiving end and a spark plug terminal location chamber intermediate thereof, the terminal location chamber communicating with a first chamber and a second end chamber located on either side of the terminal location chamber, the first chamber to receive the spark plug and the second chamber, to receive an ignition lead, the ignition lead having a terminal connector located in the terminal location chamber, the terminal location chamber having a circumferential restriction adjacent the first end chamber and the second end chamber of transverse dimension less than the transverse dimension of the terminal connector.

Thus when the ignition boot is manufactured of resilient material, a terminal may be located within the terminal location chamber and restrained from removal from that chamber or any other unwanted movement by the spaced circumferential restrictions (e.g. ribs). The provision of these restrictions ensures that the terminal is properly located and orientated towards the spark plug terminal and cannot readily be removed by pulling the ignition lead. As will be readily apparent to those skilled in the art, an ignition lead is clamped or otherwise affixed to the terminal prior to its location within the terminal location chamber. Thereafter the boot may be inflated to permit the ignition lead and terminal to be properly positioned in the boot.

In a preferred embodiment the terminal location chamber has a transverse dimension which approximates or is less than the outer transverse dimensions of the terminal to be inserted thereby providing not only a secure fit but facilitating additional sealing against ingress of moisture.

In a fourth aspect of the present invention there is provided an elongated ignition boot for a spark plug comprising a channelway extending from a spark plug receiving aperture to an ignition lead aperture, the channelway being provided with a circumferential restriction, such that in use an ignition lead with a connector is located in the channelway and the restriction is positioned adjacent the ignition lead aperture to substantially prevent ingress of dust or moisture into the boot.

More particularly a plurality of constrictions may be provided in a longitudinally extending opening adapted to receive an ignition lead and connector. These restrictions are preferably adjacent the ignition lead/connector joint and the ignition lead aperture of the boot. Intermediate restrictions can also be included. Preferably these restrictions are in the form of ribs integrally formed in the inner surface of the longitudinally extending opening.

In a fifth aspect of the invention there is provided an elongated ignition boot for a spark plug having an insulator section and a terminal, the spark plug being located in a spark plug receiving cavity of a cylinder comprising (i) a spark plug receiving aperture
(ii) a lead receiving aperture to receive an ignition lead and connector terminal
(iii) a channelway passing from the spark plug receiving aperture to the ignition lead receiving aperture the channelway constituted by
  (a) a first chamber adjacent the spark plug receiving aperture having a transverse dimension substantially exceeding the transverse dimension of the terminal and that part of the insulator section located therein
  (b) a second chamber
  (c) a terminal location chamber located between the first chamber and second chamber
  (d) a pair of circumferential restrictions in the terminal location chamber adjacent the first chamber and second chamber of transverse dimension less than the transverse dimension of the terminal connector;
  (e) a sealing chamber intermediate the spark plug receiving aperture and the first chamber, to engage the insulator section of the spark plug; and
(iv) sealing means located peripherally at or adjacent the spark plug receiving aperture and urgable against wall(s) of the spark plug receiving cavity.

DESCRIPTION OF THE DRAWINGS

The above separate aspects of the invention will now be illustrated with reference to the accompanying drawings which feature a boot incorporating all of the aforementioned features:

As shown in FIG. 1, there is a boot having opening A and opening B. A passageway C extends between openings A and B and is defined by chambers 1, 2, 3, 4, 5 and 6. Chamber 3 is of substantially the same dimensions as a connector and has constrictions 7 and 8 defining the ends of the chamber 3. Chambers 4 and 5 have dimensions approximating that of an ignition lead which is connected to the connector to be located in chamber 3. Chambers 4 and 5 are defined by rib 8, rib 9 and constriction 10. Constriction 10 extends adjacent end A. Thus when the connector is affixed to the lead, it is inserted via opening A so that it is located in chamber 3 between ribs 7 and 8. Ribs 7 and 8 securely hold the connector in place thus avoiding any unwanted dislocation should the lead be pulled upon. As the ingress of moisture to chambers 3, 4, 5 and 6 is to be substantially prevented, ribs 8, 9 and extended constriction 10 provide 3 sealing barriers against moisture.

Figure 1:
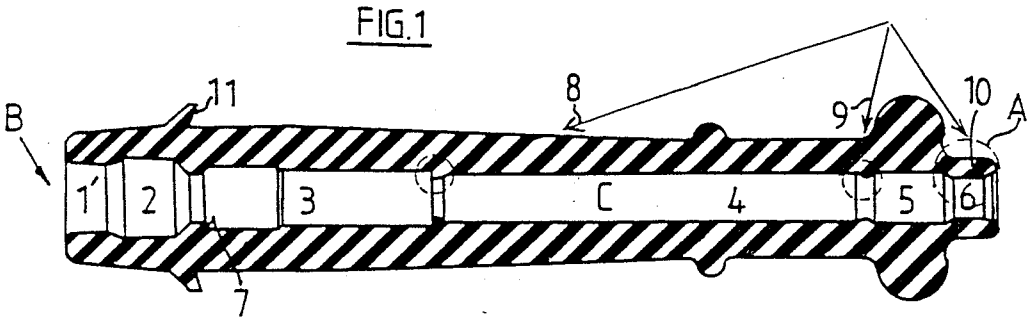
FIG. 1 is a cross-sectional view of a boot incorporating all the features of the present invention.

Opening B of boot 1 is of a width to permit the terminal and insulator of a spark plug to be inserted therethrough. Chamber 2 is of expanded size having inner surfaces spaced from the spark plug insulator when fully inserted through opening B. In the fully inserted position the terminal protrudes between chambers 2 and 3 and is securely located in the connector in chamber 3.

The oversizing of chamber 2 in concert with the snug fit of chamber 1 about the base of the insulator of the spark plug ensures not only an effective seal against moisture travelling to the connection point of the lead and spark plug, but also permits easier location of the spark plug connector in the lead connector notwithstanding varying sizes of the insulation portion of a spark plug.

Figure 3:
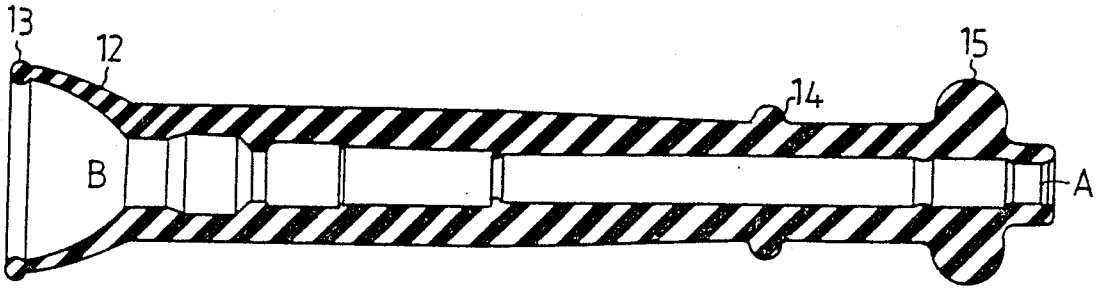
FIG. 3 is a cross-sectional view of another boot according to the invention having different sealing means.

The sealing ring 11 is also provided adjacent chamber 2 and as boot 1 is inserted over the spark plug within the spark plug cavity formed in the cylinder head, (not shown) sealing ring 11 rides up against and substantially seals the spark plug against the cavity. In an alternate embodiment as shown in FIG. 3 instead of sealing ring 11, a sealing cover 12 is formed about opening B. Sealing cover 12 has a ring 13 formed in its outer periphery which is forced against the base wall of the cavity formed in the cylinder head and may also ride against the side walls. In either sealing arrangement the purpose is to substantially inhibit moisture from migrating about the spark plug.

The boot may also provide grips 14 and 15 which not only provide a gripping function for the user but also serve to add rigidity to the lead containing portion of the boot where it is needed.

Figure 2:
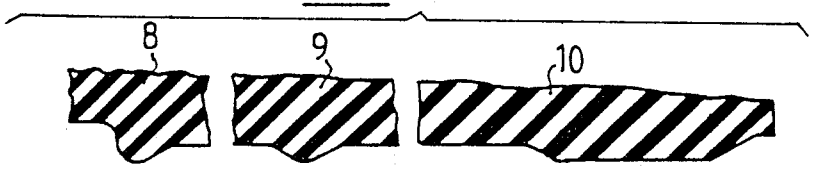
FIG. 2 are exploded cross-sectional views of ribs of FIG. 1.

FIG. 2 shows enlarged details of the retaining and sealing ribs and sealing surfaces described earlier.

Utilising any one of the aspects of the present invention, results in an ignition boot which has improved sealing capabilities against moisture and/or more secure location of the connection between the spark plug and ignition lead.

I claim:

1. An ignition boot for a spark plug located in a spark plug receiving cavity of a cylinder comprising a spark plug receiving aperture at one end and sealing means located peripherally at or adjacent the spark plug receiving aperture and urgable against wall(s) of the spark plug receiving cavity thereby substantially preventing ingress of dust or moisture to the spark plug.

2. An ignition boot according to claim 1 wherein the sealing means is a ring extending about the ignition boot.

3. An ignition boot according to claim 1 wherein the sealing means extends radially and rearwardly of the spark plug receiving aperture.

4. An ignition boot according to claim 1 wherein the sealing means extends radially and outwardly of the spark plug receiving aperture.

5. An ignition boot according to claim 1 wherein the sealing means is of resilient material.

6. An elongated ignition boot for a spark plug having an insulator section and a terminal, the spark plug being located in a spark plug receiving cavity of a cylinder comprising (i) a spark plug receiving aperture (ii) a lead receiving aperture to receive an ignition lead and connector terminal (iii) a channelway passing from the spark plug receiving aperture to the ignition lead receiving aperture the channelway constituted by (a) a first chamber adjacent the spark plug receiving aperture having a transverse dimension substantially exceeding the transverse dimension of the terminal and that part of the insulator section located therein (b) a second chamber (c) a terminal location chamber located between the first chamber and second chamber (d) a pair of circumferential restrictions in the terminal location chamber adjacent the first chamber and second chamber of transverse dimension less than the transverse dimension of the terminal connector;

(e) a sealing chamber intermediate the spark plug receiving aperture and the first chamber, to engage the insulator section of the spark plug; and (iv) sealing means located peripherally at or adjacent the spark plug receiving aperture and urgable against wall(s) of the spark plug receiving cavity.

7. An elongated ignition boot according to claim 6 wherein the sealing means is a ring extending about the ignition boot.

8. An elongated ignition boot according to claim 6 wherein the sealing means extends radially and rearwardly of the spark plug receiving aperture.

9. An elongated ignition boot according to claim 6 wherein the sealing means extends radially and outwardly of the spark plug receiving aperture.

10. An elongated ignition boot according to claim 6 wherein the sealing means is of resilient material.

11. An elongated ignition boot according to claim 6 wherein the channelway is provided with a restriction adjacent the lead receiving aperture to substantially prevent ingress of dust or moisture into the boot.

* * * * *